US007772494B2

(12) United States Patent
Vexler et al.

(10) Patent No.: US 7,772,494 B2
(45) Date of Patent: Aug. 10, 2010

(54) WEB FOR SEPARATING CONDUCTORS IN A COMMUNICATION CABLE

(75) Inventors: Gavriel Vexler, Westmount (CA); Galen Gareis, Fort Mill, SC (US)

(73) Assignee: Belden Technologies, Inc., St. Louis, MO (US)

( * ) Notice: Subject to any disclaimer, the term of this patent is extended or adjusted under 35 U.S.C. 154(b) by 324 days.

(21) Appl. No.: 11/682,415

(22) Filed: Mar. 6, 2007

(65) Prior Publication Data

US 2007/0209823 A1 Sep. 13, 2007

Related U.S. Application Data

(60) Provisional application No. 60/778,930, filed on Mar. 6, 2006, provisional application No. 60/885,691, filed on Jan. 19, 2007.

(30) Foreign Application Priority Data

Mar. 6, 2006 (CA) ..... 2538637

(51) Int. Cl.
*H01B 7/00* (2006.01)

(52) U.S. Cl. ..... 174/113 R; 174/113 C

(58) Field of Classification Search ..... 174/110 R, 174/113 R, 113 C, 120 R, 113 AS, 120 SR, 174/120 SP
See application file for complete search history.

(56) References Cited

U.S. PATENT DOCUMENTS 3,363,047 A 1/1968 Grove
4,604,862 A 8/1986 McGettigan et al.
5,969,295 A * 10/1999 Boucino et al. ..... 174/113 C
6,297,454 B1 10/2001 Gareis
6,318,062 B1 11/2001 Doherty
6,365,836 B1 * 4/2002 Blouin et al. ..... 174/113 C
6,800,811 B1 * 10/2004 Boucino ..... 174/113 C
6,875,928 B1 4/2005 Hayes et al.
7,098,405 B2 8/2006 Glew
7,115,815 B2 10/2006 Kenny et al.
7,135,641 B2 * 11/2006 Clark ..... 174/110 R
7,145,080 B1 * 12/2006 Boisvert et al. ..... 174/110 R
7,173,189 B1 * 2/2007 Hazy et al. ..... 174/110 R
7,179,999 B2 * 2/2007 Clark et al. ..... 174/113 R
7,196,271 B2 3/2007 Cornibert et al.
7,197,291 B2 * 3/2007 Mach et al. ..... 455/303
7,390,971 B2 * 6/2008 Jean et al. ..... 174/113 AS
7,399,937 B2 * 7/2008 Nishimura ..... 200/314
7,449,638 B2 * 11/2008 Clark et al. ..... 174/113 C
7,507,910 B2 * 3/2009 Park et al. ..... 174/113 C (Continued)

*Primary Examiner*—William H Mayo, III
(74) *Attorney, Agent, or Firm*—Lando & Anastasi, LLP

(57) ABSTRACT

A telecommunications cable having a cable jacket defining an elongate cable core, a conductor assembly comprising four twisted pairs of conductors disposed along the core and parallel elongate distensions formed on an inner surface of the cable jacket. The distensions are spaced about an inner surface of the cable jacket and prevent the conductor assembly from coming into contact with the inner surface. The distensions can be the result of a series of filler elements placed between the cable jacket and the cable core and which wind helicoidally along and about the cable core. A separator spline has first and second elongate dividing strips having a substantially H shaped cross section and arranged side by side. The spline twists helicoidally along its length. The separator spline and the insulation surrounding the twisted pairs of conductors can be manufactured form a material having the same dielectric constant.

27 Claims, 7 Drawing Sheets

U.S. PATENT DOCUMENTS

2003/0132021 A1* 7/2003 Gareis ..... 174/113 C
2004/0149483 A1* 8/2004 Glew ..... 174/113 C
2005/0092515 A1 5/2005 Kenny et al.
2005/0247479 A1* 11/2005 Kenny et al. ..... 174/113 R
2007/0044994 A1* 3/2007 Park et al. ..... 174/113 C
2007/0144762 A1* 6/2007 Stutzman et al. ..... 174/113 C
2007/0163800 A1* 7/2007 Clark et al. ..... 174/113 C
2008/0093106 A1* 4/2008 Lique et al. ..... 174/113 C

* cited by examiner

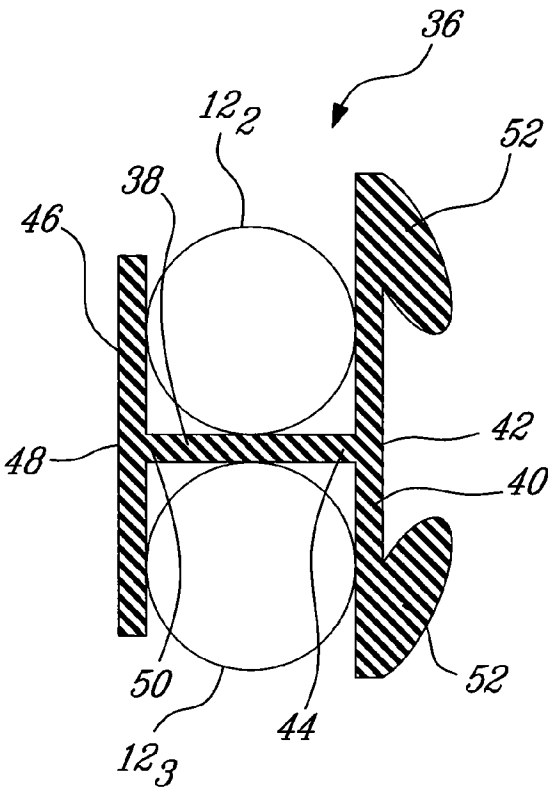
Fig-2C
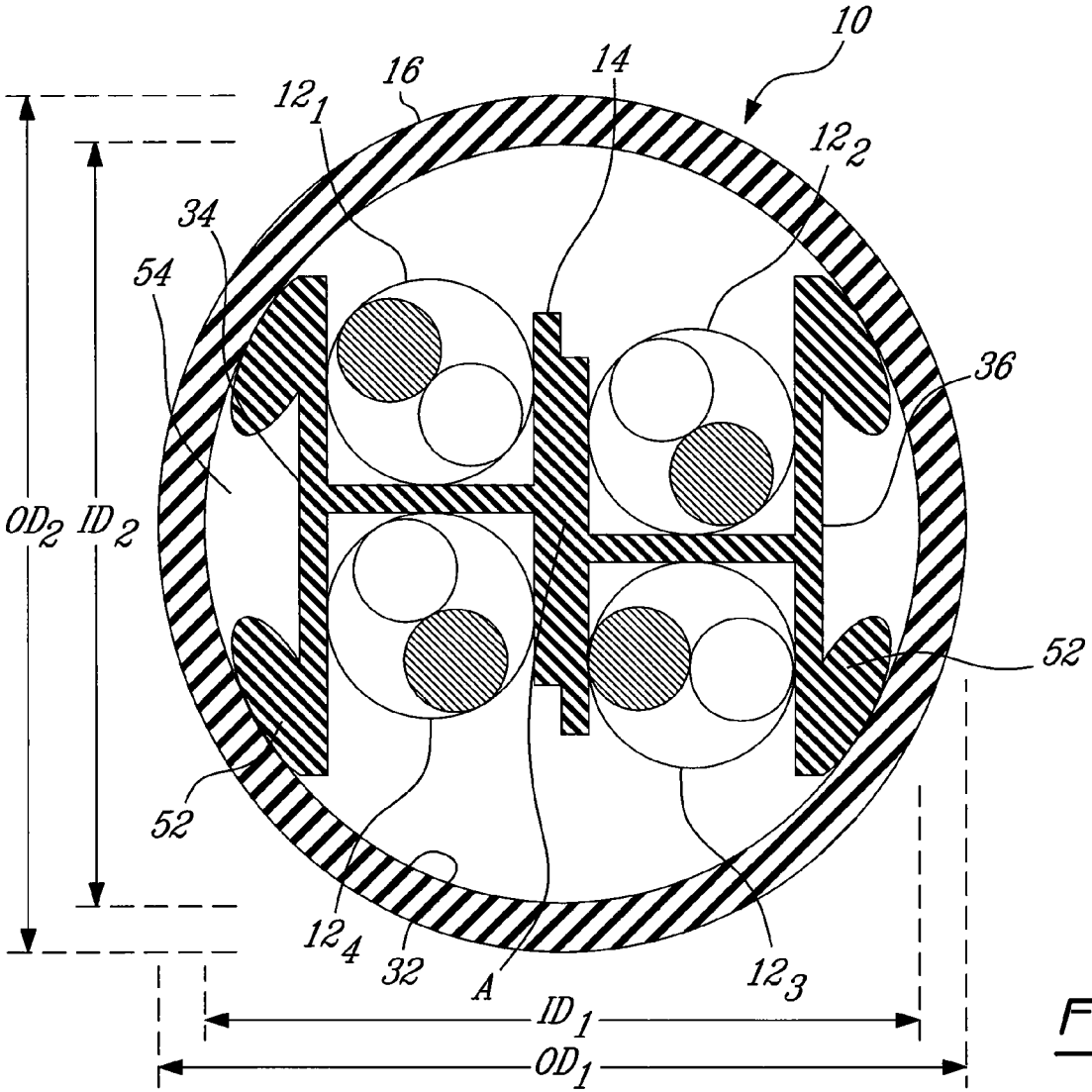

WEB FOR SEPARATING CONDUCTORS IN A COMMUNICATION CABLE

CROSS REFERENCE TO RELATED APPLICATIONS

The present application claims priority from U.S. Provisional Application No. 60/778,930 filed on Mar. 6, 2006, Canadian Patent Application No. 2,538,637 filed on Mar. 6, 2006, and U.S. Provisional Application No. 60/885,691 filed on Jan. 19, 2007, the entirety of which is incorporated herein by reference

FIELD OF THE INVENTION

The present invention relates to a web for separating conductors in a communications cable. In particular, the present invention relates to a cross talk reducing separator web, or spline, which ensures predetermined positioning of twisted pairs of conductors relative to one another.

BACKGROUND TO THE INVENTION

One problem which must be surmounted when implementing high speed data communications such as the 10 Gigabit Ethernet is the reduction in cross talk between adjacent cables, typically referred to as Power Sum Alien Near End Cross (PSANEXT) and Power Sum Alien Equal Level Far End Cross Talk (PSAELFEXT). One technique which has been proposed and been shown effective in lower speed networks is the use of separator web or spline running along the length of the cable and positioned between the four (4) twisted pairs of conductors which are used for transferring data along the cable. One drawback of these prior art designs is that when such prior art cables are placed adjacent to one another (as is typically the case in cable runs and conduit and the like), the twisted pairs having the longest twist in a given cable are the same distance from the geometric centre of the cable as the other twisted pairs. As an increase in proximity of twisted pairs of conductors located in adjacent cables and having longer twist lays increases PSANEXT and PSAELFEXT (due to an increased coupling between twisted pairs having longer lays relative to those having shorter lays). In addition, each individual pair exhibits relatively high levels of unbalance known to cause common mode signal noise. This can lead to a degradation in the performance of (and therefore the signals being transmitted by) each of the cables which cannot be compensated for due to the large number of noise signals originating from like pairs of a typically a large number of adjacent cables (up to 6 adjacent cables and 48 disturbing twisted pairs of conductors in a worst case).

SUMMARY OF THE INVENTION

The present invention addresses the above and other drawbacks by providing a telecommunications cable comprising a cable jacket defining an elongate cable core, four twisted pairs of conductors disposed along the core, each of the conductors comprising a conductive core surrounded by an insulation, and a spline separating the four twisted pairs of conductors from one another. The spline and the insulation are fabricated from a material having a matching dielectric constant.

There is also disclosed a telecommunications cable comprising a cable jacket defining an elongate cable core, four twisted pairs of conductors disposed along the core and a plurality of parallel displacing ridges in an outer surface of the cable jacket, the ridges substantially evenly spaced about an outer circumference of the cable jacket and winding helicoidally along the cable about the core.

Furthermore, there is described a telecommunications cable comprising a cable jacket defining an elongate cable core, a conductor assembly comprising four twisted pairs of conductors disposed along the core, and a plurality of parallel elongate localised and like distensions in an inner surface of the cable jacket, the distensions substantially evenly spaced about an inner surface of the cable jacket. The distensions prevent the conductor assembly from coming into contact with the inner surface.

Additionally, there is disclosed a separator spline for use in a telecommunications cable. The spline comprises first and second elongate dividing strips having a substantially H shaped cross section and arranged side by side. The spline twists helicoidally along its length.

BRIEF DESCRIPTION OF THE DRAWINGS

FIG. 2C is a transverse cross section of a telecommunications cable in accordance with a second alternative illustrative embodiment of the present invention as well as a table of some illustrative values in millimeters of dimensions for a separator web of same;

FIG. 2D is a transverse cross section of a telecommunications cable in accordance with a third alternative illustrative embodiment of the present invention as well as a table of some illustrative values in millimeters of dimensions for a separator web of same;

DETAILED DESCRIPTION OF THE ILLUSTRATIVE EMBODIMENTS

Figure 1:
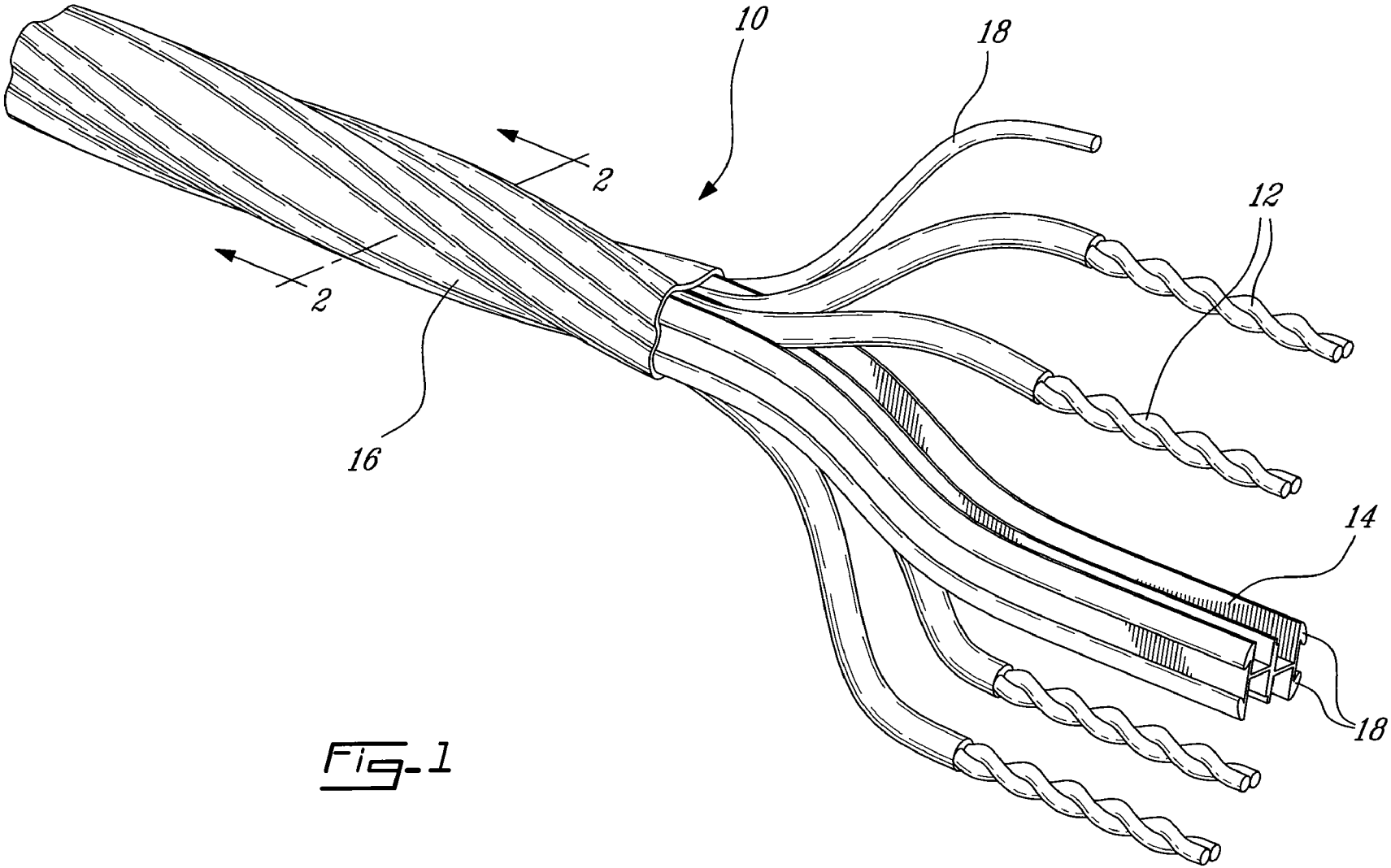
FIG. 1 is a raised side view of a telecommunications cable in accordance with an illustrative embodiment of the present invention.

Referring now to FIG. 1, a telecommunications cable, generally referred to using the reference numeral 10, will now be described. The cable 10, is comprised of four (4) twisted pairs of conductors 12 separated by a separator web 14 and encased in a cable jacket 16. In a particular embodiment one or more filler elements as in 18 can be included positioned between the cable jacket 16 and the conductors 12. Additionally, a shielding foil or the like (not shown) may also be included between positioned between cable jacket 16 and the filler elements 18.

Still referring to FIG. 1, as known in the art, the twisted pairs of conductors 12 are typically twisted with different twist lays (i.e. number of twists per unit length). These twist lays can be regular and predetermined or can vary along the length of the cable 10, for example between a maximum and a minimum value. In the latter case, the twist lays can vary either randomly or in accordance with a predetermined pattern (for example steadily increasing or decreasing over a predetermined distance). Of note is that the direction of lay is often reversed at points along a given twisted pair of conductors as in 12 in order to simplify manufacturing.

Still referring to FIG. 1, the separator web 14 separating the twisted pairs of conductors 12 from one another also typically twists helically along a length of the cable 10 such that the individual twisted pairs of conductors as in 12 follow substantially parallel helical paths along the length of the cable. Similar to the twist lay of the individual twisted pairs of conductors as in 12, the lay of the individual twisted pairs of conductors as in 12 (typically referred to as the strand lay) as the travel along the length of the cable 12 can be either constant or can vary between a minimum and maximum stand lay. In the latter case, the rate of variance can be either or random or predetermined (again, for example, a steady increase or decrease between a minimum and maximum stand lay along a length of the cable 10).

Figure 2A:
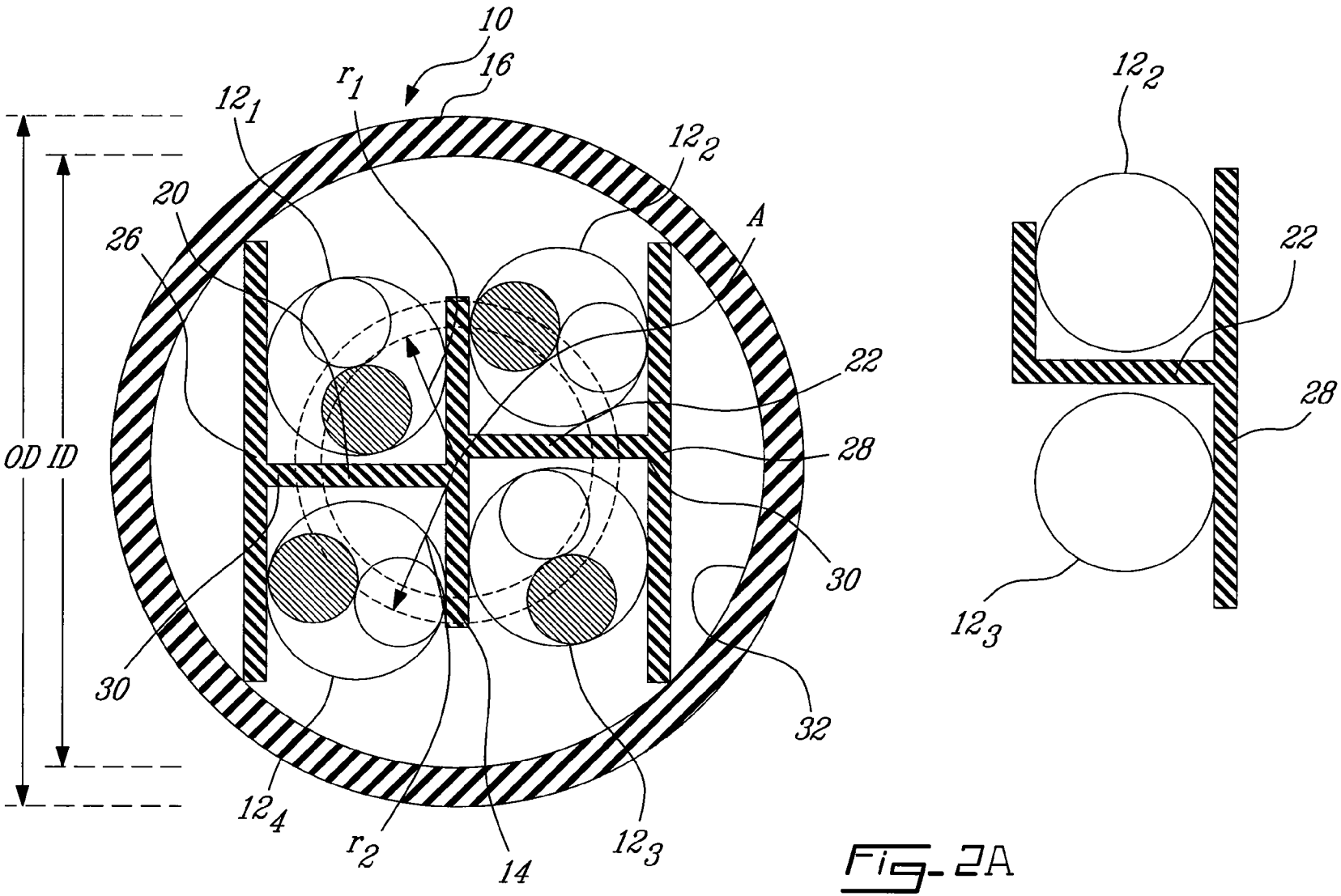
FIG. 2A is a transverse cross section of a telecommunications cable in accordance with an illustrative embodiment of the present invention as well as a table of some illustrative values in millimeters of dimensions for a separator web of same.

Referring now to FIG. 2A, in an illustrative embodiment of the present invention, a separator web 14 comprising two (2) separating parts 20, 22 having an L shaped transverse cross section and touching along a heel 24 thereof is provided. The separating parts having the L shaped transverse cross-section 20, 22 separate the core of the cable 10, as defined by the cable jacket 16 into four quadrants. One of each of the twisted pairs as in 12 rests in each of the quadrants. A second pair of substantially flat, parallel and opposed spacing elements as in 26, 28 are attached along an outer edge as in 30 of each of the separating parts having the L shaped transverse cross-section 20, 22.

In a particular embodiment each of the separating parts having the L shaped transverse cross-section 20, 22 is fabricated together with its spacing element as in 26, 28 thereby forming an "h" shaped web portion. During cable manufacture the two (2) "h" shaped web portions (each comprised of a separating part having an L shaped transverse cross-section 20, 22 and a spacing element as in 26, 28) in parallel and subsequently stranded together with the four (4) twisted pairs of conductors as in 12 to form the core of the cable 20 and in particular the finished separator web 14. In this regard the separating parts having the L shaped transverse cross-section 20, 22 of each "h" shaped web portion touch along a heel thereof (which incidentally coincides with the geometric centre A of the cable 10).

The position of the two (2) "h" shaped web portions can be offset or staggered relative to one another which in turn staggers the positioning of the four (4) twisted pairs of conductors as in 12 relative to one another. In particular, the twisted pairs of conductors as in 12 having the longest twist lays (illustratively twisted pairs $\mathbf{12}_1$ and $\mathbf{12}_3$) can be positioned closer to one another and the twisted pairs having the shorter twist lays (illustratively twisted pairs $\mathbf{12}_2$ and $\mathbf{12}_4$) can be positioned farther from one another. In this regard, a radius $r_1$ of a double helix formed by the twisted pairs $\mathbf{12}_1$ and $\mathbf{12}_3$ having the longer twist lays is less than a radius $r_2$ of a double helix formed by the twisted pairs $\mathbf{12}_2$ and $\mathbf{12}_4$ having the shorter twist lays. As a result, the twisted pairs $\mathbf{12}_1$ and $\mathbf{12}_3$ having the longer twist lays are located closer to the geometric centre (designated by the point A) of the cable 10 than the twisted pairs $\mathbf{12}_2$ and $\mathbf{12}_4$ having the shorter twist lays.

Still referring to FIG. 2A, locating the twisted pairs having longer twist lays closer to the centre A of the cable 10 has a number of effects. For example, and now as will be apparent to a person of skill in the art, the twisted pairs having the longer twist lays of adjacent cables will now be farther apart. As discussed above, the coupling between twisted pairs having longer lays is greater than those having shorter lays and therefore an increase in distance between those twisted pairs having longer twist lays in this manners leads to a reduction in PSANEXT and PSAELFEXT. Additionally, the increased distance is filled primarily with dry air which is a better dielectric than plastics, which also leads to a reduction in coupling and a resultant twisted pairs having the longer twist lays. Furthermore, the twisted pairs having shorter lays generally incorporate more conductive material per unit length than twisted pairs having longer twist lays, and therefore a shielding effect arises.

Still referring to FIG. 2A, the "h" shaped web portions of the separator web 14 also serve to prevent the twisted pairs of conductors 12 from touching the inside surface 32 of the cable jacket 16. As known in the art, such cable jackets are typically manufactured from PVC or the like which has relatively high dielectric constant with a resultant increased loss factor. By separating the twisted pairs of conductors 12 from the inside surface 24 of the cable jacket 16 using air space and the separator web 14, the composite dielectric constant and loss factor can be lowered. As a result, less copper conductor and insulation must be used to meet, for example, the attenuation requirements of the Category 6 augmented standard.

Of note is that the individual "h" shaped web portions of the separator web 14, although illustrated as being reverse mirrored images of one another, do not have to be of the same dimension. Indeed, in a particular embodiment the dimensions of each of the "h" shaped web portions can be different in order to achieve a desired positioning of the twisted pairs of conductors 12 relative to one another, relative to the centre A of the cable 12 and relative to the inside surface 24 of the cable jacket 16.

Figure 2B:
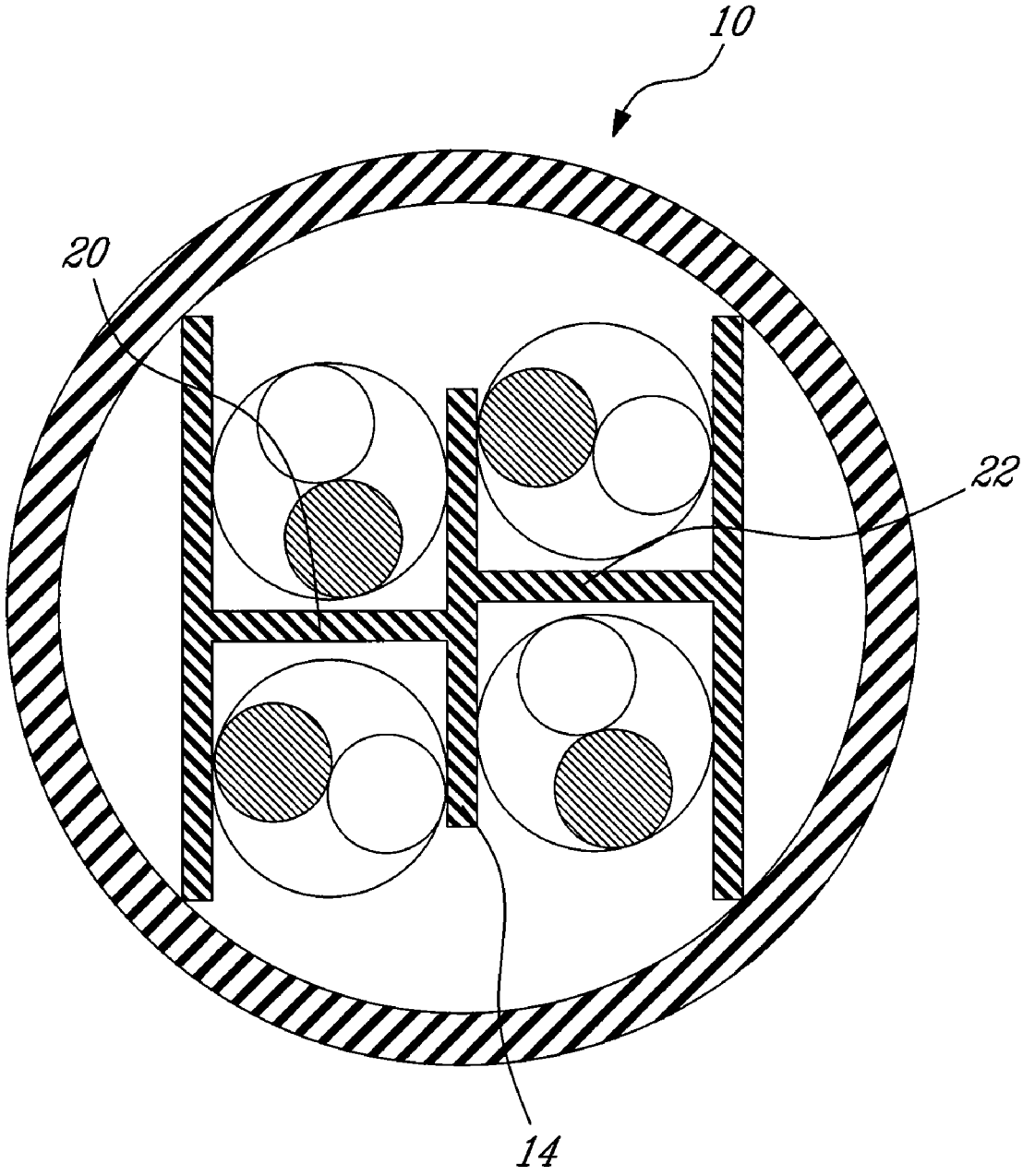
FIG. 2B is a transverse cross section of a telecommunications cable in accordance with an alternative illustrative embodiment of the present invention as well as a table of some illustrative values in millimeters of dimensions for a separator web of same.
Figure 20:
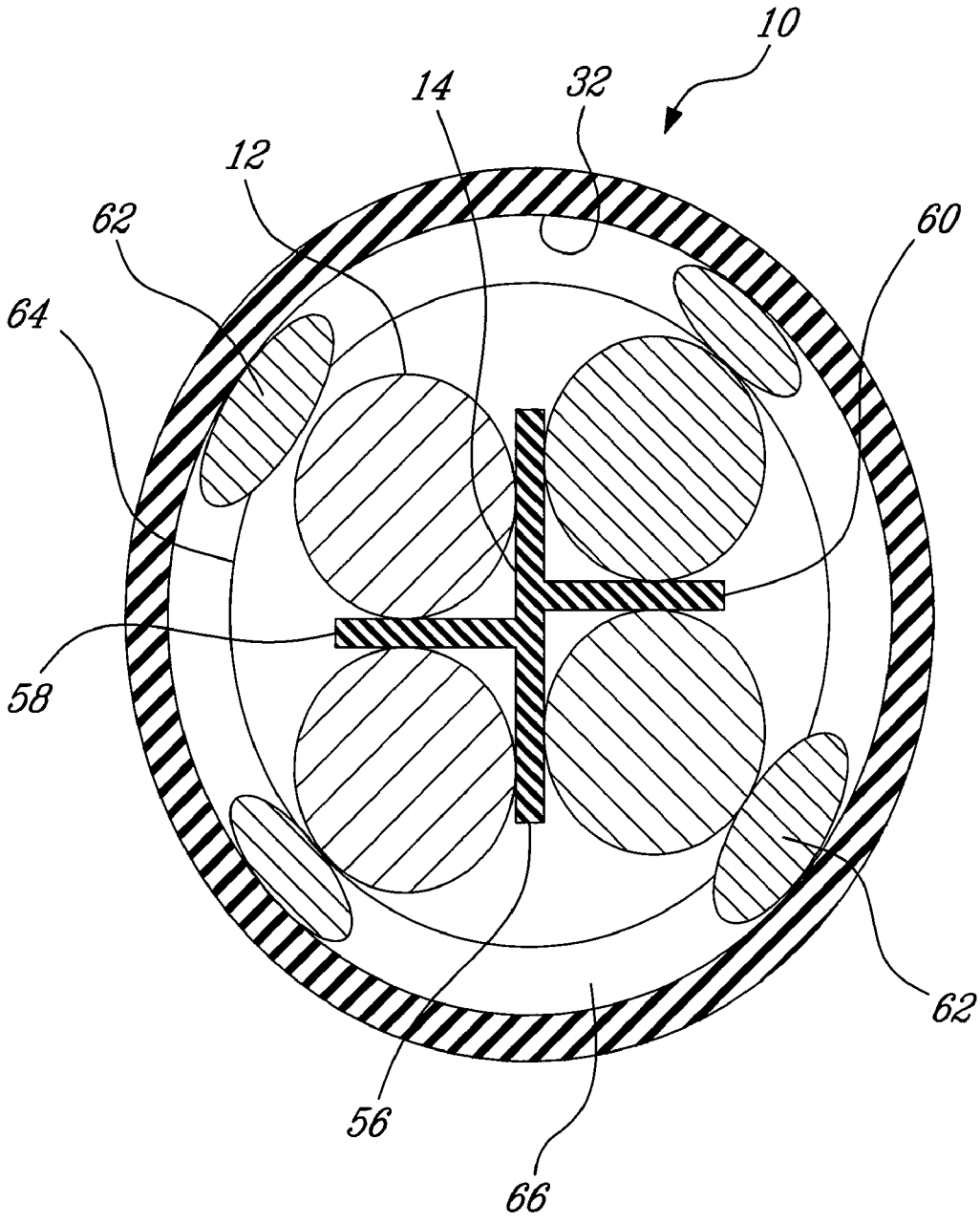

Referring to FIG. 2B, in an alternative illustrative embodiment, the two (2) "h" shaped web portions are co-joined, either during manufacture of the separator web 14 or subsequently using a bonding technique such as a suitable adhesive, welding, etc.

Referring now to FIG. 2C, in a second alternative illustrative embodiment of the cable 10 of the present invention, the separator web 14 is comprised of two (2) "H" shaped web portions 34, 36. Each of said "H" shaped web portions 34, 36 is comprised of a central strip 38, an inner strip 40 attached towards a centre 42 thereof at right angles to an inner edge 44 of said central strip 38 and an outer strip 46 attached towards a centre 48 thereof at right angles to an outer edge 50 of said central strip 38. Similar to the "h" shaped web portions as discussed hereinabove the position of the two (2) "H" shaped web portions 34, 36 can be offset or staggered relative to one another which in turn staggers the positioning of the four (4) twisted pairs of conductors as in 12 relative to one another. In particular, the twisted pairs of conductors as in 12 having the longest twist lays (illustratively twisted pairs $\mathbf{12}_2$ and $\mathbf{12}_4$) can be positioned closer to one another and the twisted pairs having the shorter twist lays (illustratively twisted pairs $\mathbf{12}_1$ and $\mathbf{12}_3$) can be positioned farther from one another. As a result, the twisted pairs $\mathbf{12}_2$ and $\mathbf{12}_4$ having the longer twist lays are located closer to the geometric centre (again designated by the point A) of the cable 10 than the twisted pairs $\mathbf{12}_1$ and $\mathbf{12}_3$ having the shorter twist lays.

The H shaped web portions 34, 36 also illustratively include a pair of filler elements as in 52. The filler elements as in 52 are positioned between the inner surface 32 of the cable jacket 16 and the H shaped web portions 34, 36. The filler elements illustratively serve to introduce more air space as in 54 between the inner surface 32 of the jacket 16 and the twisted pairs of conductors as in 12. Additionally, the filler elements as in 52 ensure that the inner surface 32 of the jacket 16 is smooth in those regions where the jacket 16 is proximate to the H shaped web portions 34, 36.

Additionally, and in a particular variant of the second alternative illustrative embodiment, the two (2) "H" shaped web portions 34, 36 are co-joined, either during manufacture of the separator web 14 or subsequently using a bonding technique such as a suitable adhesive, welding, etc.

Referring now to FIG. 2D, in a third alternative illustrative embodiment of the present invention, the separator web 14 comprises a first strip 56 onto a first side of which is attached a second strip 58 and onto a second side of which is attached a third strip 60. The second strip 58 and third strip 60 are attached to the first strip 54 such that the second strip 58 is nearer one end of the first strip 54 than the third strip 60, thereby giving the separator web 14 a staggered X transverse cross section. Additionally, one or more filler elements as in 62 is provided. The filler elements as in 62 can be either individually wound about the twisted pairs of conductors as in 12 and the separator web 14 during manufacture or alternatively can form part of or otherwise be attached to a sheath as in 64 which surrounds the twisted pairs of conductors as in 12 and the separator web 14. The filler elements as in 62 introduce air spaces as in 66 between the twisted pairs of conductors as in 12 and the inner surface 32 of the cable jacket 16.

Figure 2E:
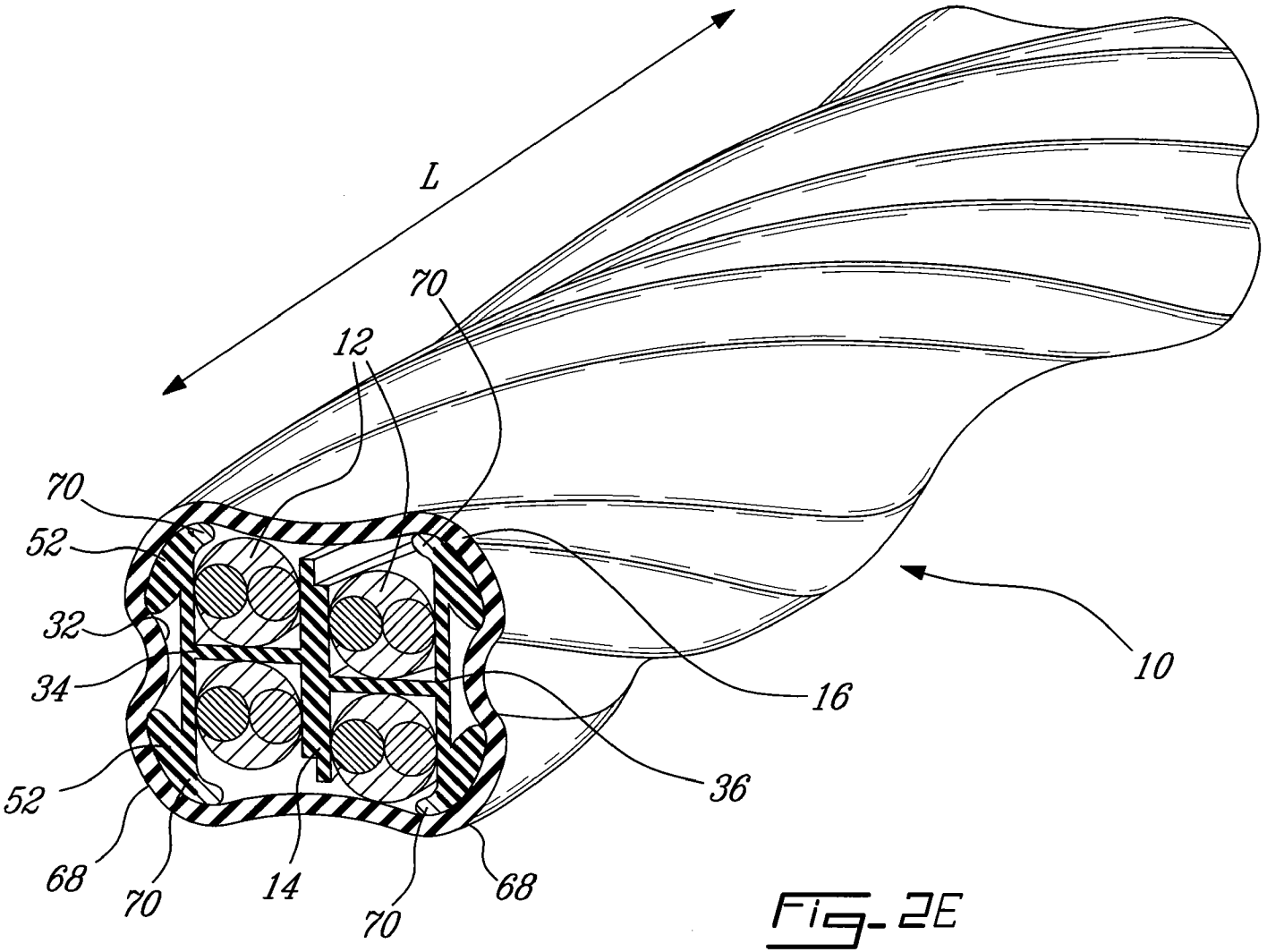
FIG. 2E is a detailed view of a transverse cross section of the telecommunications cable of FIG. 2C.

Referring now to FIG. 2E, in practice when the (typically PVC) cable jacket 16 is extruded over the twisted pair 12/separator web 14 the filler elements 48 introduce a series of elongate depressions in the inner surface of the cable jacket 16 which results in corresponding series of four (4) ridges as in 68 being formed in the outside of the cable jacket 16 in the region of the filler elements 38. As the separator web is twisted helicoidally along the length L of the cable 10, the ridges as in 68 also twist along the length L of the cable 10. One advantage of such a construction is that the provision of a plurality of ridges as in 68, in this case four (4), ensures that adjacent cables as in 10 are unable to nest, which increases the distance between adjacent cables, thereby reducing PSANEXT and PSAELFEXT with a corresponding improvement in high frequency performance. Additionally, the cable jacket 16 may also slightly deform the ends as in 70 of the two (2) "H" shaped web portions 34, 36 where the filler elements 52 are located, thereby ensuring the twisted pairs as in 12 remain displaced from the inner surface 32 of the cable jacket 16.

Additionally, the balance of the pairs may be further improved by ensuring that the materials used to manufacture the separator web 14, the filler elements 52 and the insulation surrounding the twisted pairs of conductors 12 all have the same or similar dielectric properties.

Figure 2F:
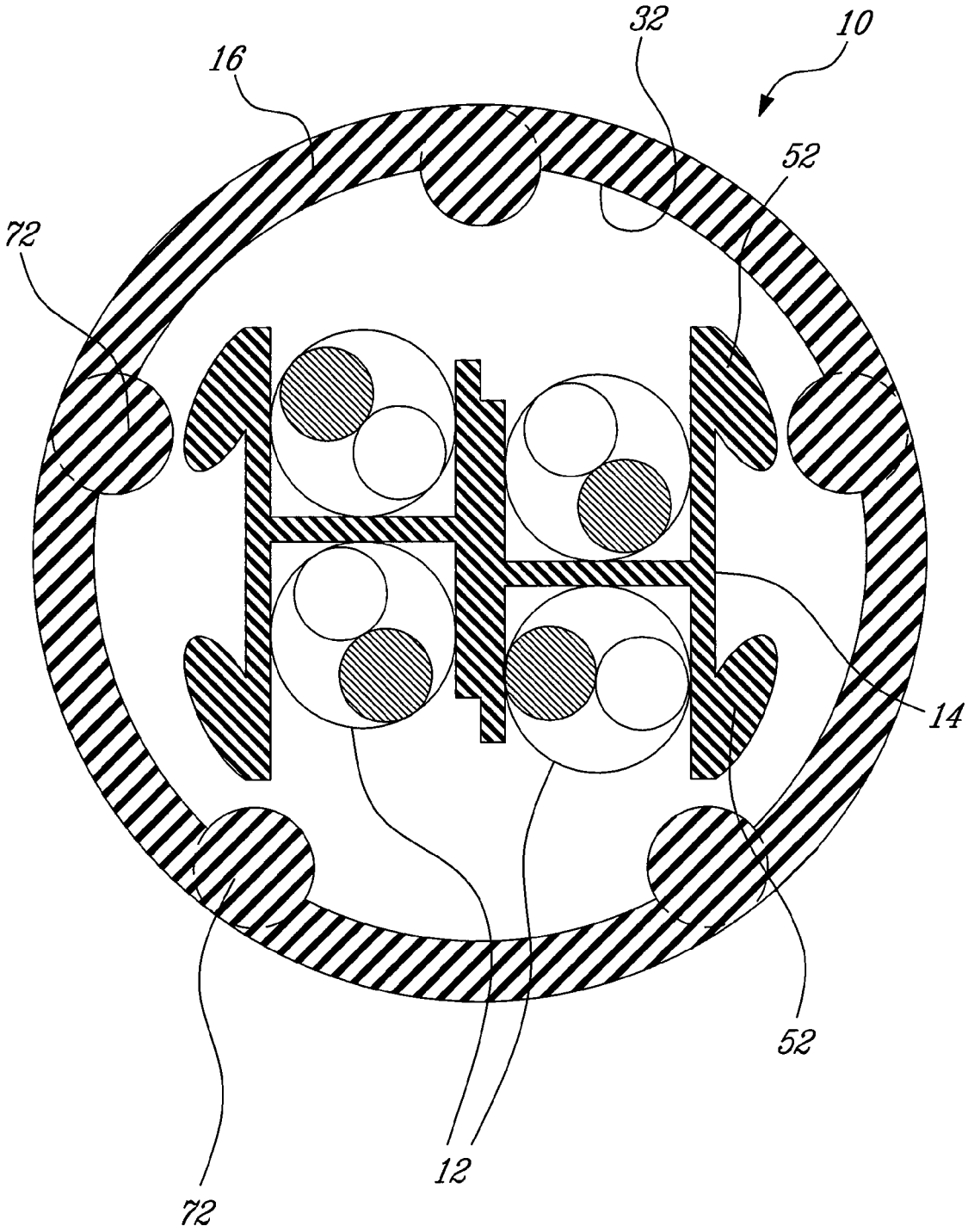
FIG. 2F is a detailed view of a transverse cross section of a telecommunications cable in accordance with a fourth alternative illustrative embodiment of the present invention.

Referring now to FIG. 2F, in a fourth illustrative embodiment of the present invention the inner surface 32 of the cable jacket 16 may be fluted during the extruded process to include a series of small raised undulations or distensions as in 72, illustratively of partially-spherical cross section. The distensions as in 72 typically run straight along the length of the cable 10, or alternatively twist helicoidally opposite to the direction of helicoidal twist of the twisted pair 12/separator web 14 assembly, and therefore do not nest between the filler elements as in 52 of the separator web 14. As a result, a smaller number (illustratively four or five distensions as in 72) of smaller diameter can be used, thereby reducing the amount of material which must be added in order to form the distensions as in 72, while still achieving an improved separation between the twisted pairs of conductors as in 12 and inside of the cable jacket 32. In an illustrative embodiment the height of the distensions as in 72 is at least about 25% of the thickness of the jacket.

Although the present invention has been described hereinabove by way of an illustrative embodiment thereof, this embodiment can be modified at will without departing from the spirit and nature of the subject invention.

What is claimed is:

1. A telecommunications cable comprising:

a cable jacket defining an elongate cable core;

four twisted pairs of conductors disposed along said cable core, each of said conductors comprising a conductive core surrounded by an insulation;

a spline separating said four twisted pairs of conductors from one another; and at least one elongate filler element, separate from said spline, arranged helicoidally about and along said cable core;

wherein said spline, said at least one filler element and said insulation are fabricated from a material having a matching dielectric constant.

2. The telecommunications cable of claim 1, wherein the at least one elongate filler element consists of four elongate parallel evenly spaced filler elements arranged helicoidally about and along said cable core, each of said filler elements fabricated from a material having said matching dielectric constant.

3. The telecommunications cable of claim 2, wherein said four filler elements are retained in position by said spline.

4. A telecommunications cable comprising:

a cable jacket defining an elongate cable core;

a conductor assembly comprising four twisted pairs of conductors disposed along said cable core;

a plurality of parallel elongate localised and like distensions substantially evenly spaced about an inner surface of said cable jacket;

a channel in said inner surface between each adjacent pair of distensions, said channels having a width greater than a width of said distensions; and four filler elements, one of each of said filler elements positioned between said inner surface and a corresponding one of said twisted pairs of conductors;

wherein said filler elements prevent said twisted pairs from entering said channels; and wherein said distensions prevent said conductor assembly from coming into contact with said inner surface.

5. The telecommunications cable of claim 4, wherein said distensions project above said inner surface at least 25% of the thickness of said cable jacket.

6. The telecommunications cable of claim 4, wherein said filler elements have a width greater than said channel width.

7. The telecommunications cable of claim 4, wherein said four twisted pairs of conductors wind helicoidally about an axis along said cable core in a first direction and where said localised distensions wind helicoidally along said inner surface in a direction opposite to said first direction.

8. The telecommunications cable of claim 4, comprising less than six of said distensions.

9. The telecommunications cable of claim 4, wherein during manufacturing said cable jacket is extruded over said conductor assembly and further wherein said distensions are formed in said inner surface when said cable jacket is extruded.

10. A separator spline for use in a telecommunications cable, the spline comprising:

first and second elongate dividing strips having a substantially H shaped cross section and arranged side by side;

wherein said spline twists helicoidally along its length.

11. The separator spline of claim 10, wherein each of said elongate dividing strips comprises a central strip, an inner strip attached towards a centre thereof at right angles to an inner edge of said central strip and an outer strip attached towards a centre thereof at right angles to an outer edge of said central strip, wherein a pair of elongate filler elements are attached along either edge of said outer strip and further wherein an outer surface of said inner strips of said first and second dividing strips are touching one another.

12. The separator spline of claim 11, wherein said inner strip of said first dividing strip and said inner strip of said second dividing strip are fabricated from the same piece of material.

13. The separator spline of claim 11, wherein said inner strip of said first dividing strip and said inner strip of said second dividing strip are bonded together.

14. The separator spline of claim 10, wherein said first and second dividing strips are fabricated from the same piece of material.

15. The separator spline of claim 10, wherein said first and second dividing strips are bonded together.

16. A telecommunications cable comprising:

a cable jacket defining an elongate cable core;

four twisted pairs of conductors disposed along said cable core, each of said conductors comprising a conductive core surrounded by an insulation; and a spline separating said four twisted pairs of conductors from one another;

wherein said spline comprises first and second elongate dividing strips having a substantially H shaped cross section and arranged side by side; and wherein said spline and said four twisted pairs of conductors are helicoidally twisted together along the length of the telecommunications cable.

17. The telecommunications cable of claim 16, wherein each of said first and second elongate dividing strips comprises a central strip, an inner strip attached towards a centre thereof at right angles to an inner edge of said central strip, and an outer strip attached towards a centre thereof at right angles to an outer edge of said central strip; and wherein the first and second elongate dividing strips are arranged within the cable core such that an outer surface of said inner strips of said first and second elongate dividing strips are touching one another.

18. The telecommunications cable of claim 17, wherein said inner strip of said first elongate dividing strip and said inner strip of said second elongate dividing strip are bonded together.

19. The telecommunications cable of claim 17, further comprising a pair of elongate filler elements are attached at opposing ends of said outer strip of each of said first and second elongate dividing strips.

20. The telecommunications cable of claim 16, wherein said first and second elongate dividing strips are positioned offset from one another within the cable core.

21. The telecommunications cable of claim 20, wherein said four twisted pairs of conductors includes a first twisted pair having a first twist lay length, a second twisted pair having a second twist lay length, a third twisted pair having a third twist lay length, and a fourth twisted pair having a fourth twist lay length;

wherein said first and second twist lay lengths are shorter than said third and fourth twist lay lengths; and wherein an arrangement of said four twisted pairs of conductors within said cable core and the offset positioning of said first and second elongate dividing strips are such that the third and fourth twisted pairs are located closer to a geometric center of said cable core than are said first and second twisted pairs of conductors.

22. A telecommunications cable comprising:

four twisted pairs of insulated conductors, each twisted pair comprising two conductors each surrounded by an insulation and helicoidally twisted together;

a spline configured to separate said four twisted pairs of insulated conductors from one another along the length of said telecommunications cable; and a cable jacket surrounding said four twisted pairs of insulated conductors and said spline along the length of the telecommunications cable;

wherein said spline comprises a central strip, first and second side strips positioned parallel to said central strip on either side of said central strip, and first and second cross strips positioned on opposite sides of said central strip and substantially perpendicular to said central strip;

wherein said first cross strip joins said first side strip to said central strip such that a combination of said first side strip, said first cross strip and said central strip has a substantially H shaped cross-section;

wherein said second cross strip joins said second side strip to said central strip such that a combination of said second side strip, said second cross strip and said central strip has a substantially H shaped cross-section; and wherein said first and second cross strips are offset relative to one another along a cross-sectional height of said central strip.

23. The telecommunications cable of claim 22, wherein said spline is a unitary structure.

24. The telecommunications cable of claim 22, wherein said spline comprises a material having a dielectric constant that is substantially the same as a dielectric constant of said insulation of said twisted pairs.

25. The telecommunications cable of claim 22, wherein said four twisted pairs of conductors includes a first twisted pair having a first twist lay length, a second twisted pair having a second twist lay length, a third twisted pair having a third twist lay length, and a fourth twisted pair having a fourth twist lay length;

wherein said first and second twist lay lengths are shorter than said third and fourth twist lay lengths; and wherein an arrangement of said four twisted pairs of conductors within said cable core and the offset positioning of said first and second cross strips are such that the third and fourth twisted pairs are located closer to a geometric center of said cable core than are said first and second twisted pairs of conductors.

26. The telecommunications cable of claim 22, wherein said first and second side strips prevent said four twisted pairs from contacting said cable jacket.

27. The telecommunications cable of claim 22, further comprising four filler elements, each filler element being attached to a respective end of said first and second side strips.

* * * * *